US009835108B2

(12) United States Patent
Nishimura et al.

(10) Patent No.: US 9,835,108 B2
(45) Date of Patent: Dec. 5, 2017

(54) FUEL INJECTION CONTROLLER

(71) Applicant: DENSO CORPORATION, Kariya (JP)

(72) Inventors: Toshio Nishimura, Anjo (JP); Takayoshi Honda, Nagoya (JP)

(73) Assignee: DENSO CORPORATION, Kariya (JP)

( * ) Notice: Subject to any disclaimer, the term of this patent is extended or adjusted under 35 U.S.C. 154(b) by 304 days.

(21) Appl. No.: 14/017,579

(22) Filed: Sep. 4, 2013

(65) Prior Publication Data

US 2014/0069391 A1 Mar. 13, 2014

(30) Foreign Application Priority Data

Sep. 13, 2012 (JP) ..... 2012-202006

(51) Int. Cl.
*F02D 41/20* (2006.01)
*F02D 41/30* (2006.01)

(52) U.S. Cl.
CPC ..... *F02D 41/30* (2013.01); *F02D 41/20* (2013.01); *F02D 2041/2027* (2013.01); *F02D 2041/2044* (2013.01); *F02D 2041/2051* (2013.01); *F02D 2041/2058* (2013.01); *F02D 2041/2072* (2013.01)

(58) Field of Classification Search
CPC ..... F02D 41/30; F02D 41/20; F02D 41/3845; F02D 2041/2027; F02D 2200/0602; F02D 2041/2058; F02D 2041/2044; F02D 2041/2051; F02M 59/366
USPC ..... 123/472, 476, 490
See application file for complete search history.

(56) References Cited

U.S. PATENT DOCUMENTS

| | | | | |
|---|---|---|---|---|
| 5,992,391 | A | 11/1999 | Yamakado et al. | |
| 7,757,667 | B2 * | 7/2010 | Okamoto et al. | 123/499 |
| 2002/0043250 | A1 * | 4/2002 | Sugimoto et al. | 123/490 |
| 2009/0126692 | A1 * | 5/2009 | Bolz | 123/490 |
| 2009/0132180 | A1 | 5/2009 | Pearce et al. | |
| 2011/0295493 | A1 * | 12/2011 | Wilms et al. | 701/103 |
| 2012/0000445 | A1 | 1/2012 | Borg et al. | |

FOREIGN PATENT DOCUMENTS

| | | | |
|---|---|---|---|
| JP | 03-149313 | A | 6/1991 |
| JP | 04-287850 | A | 10/1992 |
| JP | 1018888 | A | 1/1998 |

(Continued)

OTHER PUBLICATIONS

Office Action dated Sep. 16, 2014 issued in corresponding JP patent application No. 2012-202006 (and English translation).

(Continued)

*Primary Examiner* — Hai Huynh
*Assistant Examiner* — Gonzalo Laguarda
(74) *Attorney, Agent, or Firm* — Posz Law Group, PLC

(57) ABSTRACT

A fuel injection controller has terminals which can be connected to the coil of the fuel injector. A first valve-open control portion supplies the valve-opening voltage to the terminals for opening the fuel injector. The first valve-open control portion stops supplying the electric supply to the coil before the fuel injector is positioned at a full-open position. Before the fuel injector is fully closed, a small injection quantity can be obtained. A demagnetization portion forms a demagnetization circuit for demagnetizing the magnetism remaining in the coil. A normal-injection portion controls the fuel injector at full-open position.

7 Claims, 10 Drawing Sheets

(56) References Cited

FOREIGN PATENT DOCUMENTS

| | | | |
|---|---|---|---|
| JP | 1047140 | A | 2/1998 |
| JP | 2007-303449 | A | 11/2007 |
| JP | 2010-532448 | A | 1/2009 |
| JP | 2010-073705 | A | 4/2010 |

OTHER PUBLICATIONS

U.S. Appl. No. 14/013,249, filed Aug. 29, 2013, Toshio Nishimura.
U.S. Appl. No. 14/013,695, filed Aug. 29, 2013, Toshio Nishimura.
Office Action dated Aug. 14, 2015 issued in co-pending U.S. Appl. No. 14/013,249.

* cited by examiner

FUEL INJECTION CONTROLLER

CROSS-REFERENCE TO RELATED APPLICATION

This application is based on Japanese Patent Application No. 2012-202006 filed on Sep. 13, 2012, the disclosure of which is incorporated herein by reference.

TECHNICAL FIELD

The present disclosure relates to a fuel injection controller which controls a fuel injector.

BACKGROUND

JP-2010-532448A, JP-2010-73705A, JP-10-18888A, and JP-10-47140A disclose a fuel injection controller which controls a fuel injector. Especially, JP-10-47140A discloses a fuel injection controller having a high speed response. A conventional fuel injection controller supplies comparatively large voltage for opening the fuel injector. While the fuel injector is fully opened, the fuel injection controller supplies comparatively small electric current for maintaining the fuel injector fully opened. Further, the conventional fuel injection controller supplies a reverse direction voltage to perform a demagnetization of the exciting circuit, when the fuel injector will be fully closed.

A fuel injection quantity of a fuel injector is adjusted by controlling a valve opening period of the fuel injector. In order to obtain small injection quantity, it is necessary to shorten the valve opening period of the fuel injector. However, in the small injection quantity, an error of injection quantity is significant. Thus, an accurate injection quantity control is difficult. For example, the error of fuel injection quantity is generated by various factors, such as an error of the mechanical shape of a fuel injector, an error of electric current, and an error of voltage.

In order to obtain small injection quantity, further improvements are necessary in a fuel injection controller.

SUMMARY

It is an object of the present disclosure to provide a fuel injection controller which can obtain small injection quantity correctly.

A fuel injection controller has terminals connectable to a coil of a fuel injector. Further, the controller has a valve-open control portion which supplies a valve-opening voltage to the terminals for opening the fuel injector and terminates the supply of the valve-opening voltage before the fuel injector is fully opened. Further, the controller has a demagnetization portion which forms a demagnetization circuit for demagnetizing a magnetism remaining in the coil after supplying the valve-opening voltage. According to the above configuration, the small injection quantity can be correctly injected.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
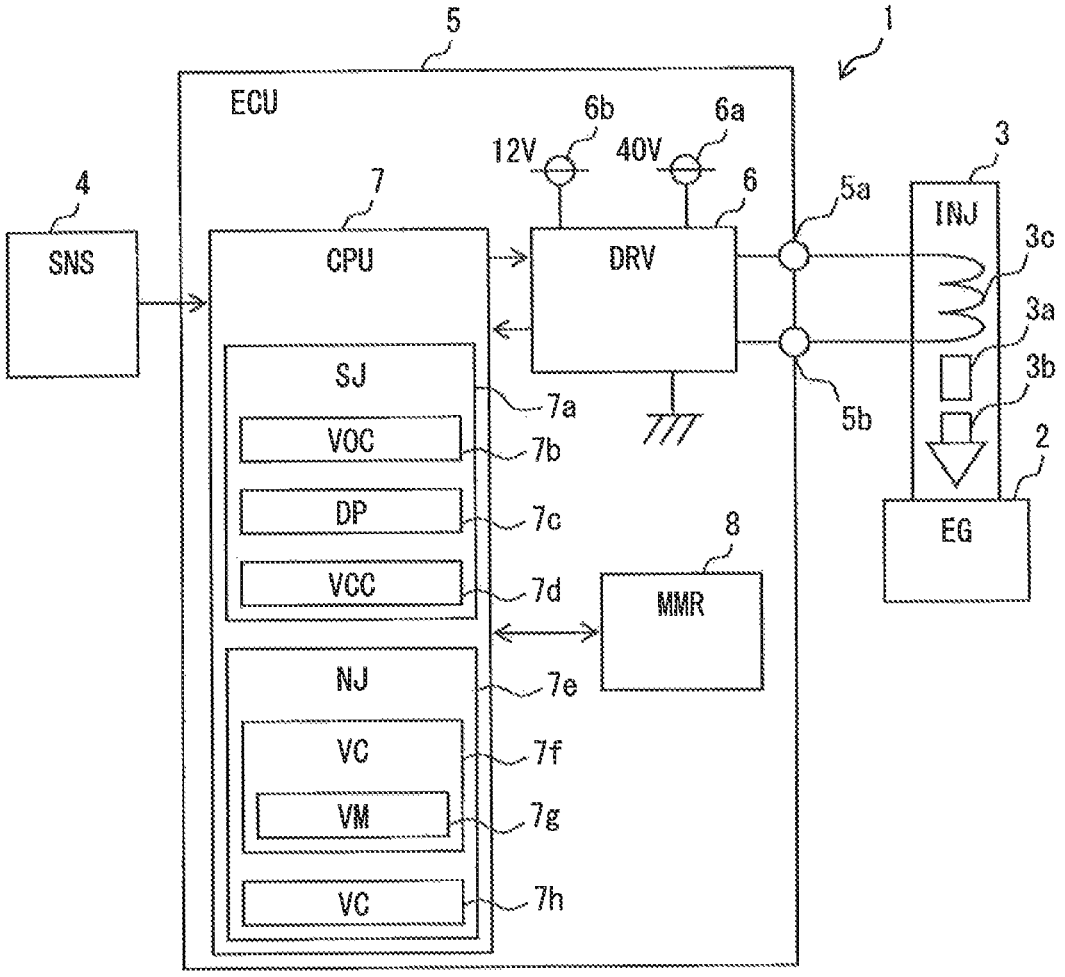
FIG. 1 is a block diagram showing an internal combustion engine system according to a first embodiment.

Referring to drawings, embodiments of the present disclosure will be described hereinafter. In these embodiments, the same parts and components as those in each embodiment are indicated with the same reference numerals and the same descriptions will not be reiterated.

First Embodiment

FIG. 1 shows an internal combustion engine system 1 according to a first embodiment. The internal combustion engine system 1 is provided with an internal combustion engine 2 for a vehicle. The internal combustion engine system 1 is provided with a fuel supply system for supplying a fuel to the internal combustion engine 2. The fuel supply system is comprised of a fuel injector (INJ) 3, multiple sensors (SNS) 4, and a fuel injection controller (ECU) 5.

The fuel injector 3 is a normally-closed type solenoid valve. The fuel injector 3 receives pressurized fuel from a fuel pump (not shown). When the fuel injector 3 is opened, the pressurized fuel is injected into the internal combustion engine 2. The fuel injector 3 is arranged in an intake passage of the internal combustion engine 2. In this case, the fuel injector 3 injects a fuel towards an intake air to form air-fuel mixture. Alternatively, the fuel injector 3 is arranged in a cylinder head of the internal combustion engine 2. In this case, the fuel injector 3 injects a fuel towards a combustion chamber.

The fuel injector 3 is comprised of a stator 3*a* including a fixed core, a needle 3*b* including a movable valve and a movable core, and a coil 3*c* for magnetizing the stator 3*a*. The coil 3*c* is a magnetic coil. When the coil 3*c* is energized, the needle 3*b* is magnetically attracted toward the stator 3*a*. The needle 3*b* is biased in a valve-closing direction by a spring (not shown).

When the coil 3*c* is not energized, the needle 3*b* is biased in a valve-closing direction. Therefore, when the coil 3*c* is not energized, the fuel injector 3 injects no fuel. When the coil 3*c* is energized, the needle 3*b* is magnetically attracted toward the stator 3*a*. The fuel injector 3 is opened to inject the fuel. There is a specified time delay from when the coil 3*c* is energized until when the fuel injector 3 is opened. When the coil 3*c* is deenergized, the fuel injector 3 is closed to stop the fuel injection. There is a specified time delay from when the coil 3*c* is deenergized until when the fuel injector 3 is closed.

The sensors 4 include an accelerator sensor, an engine speed sensor, and an intake-air sensor detecting an intake air quantity.

The fuel injection controller 5 is an electronic control unit (ECU). The ECU 5 has terminals 5*a* and 5*b* which can be connected to the coil 3*c* of the fuel injector 3. The ECU5 has a drive circuit (DRV) 6 for supplying electricity to the coil 3*c*. The drive circuit 6 has a high voltage supply 6*a* for driving the fuel injector 3 at high speed, and a low voltage supply 6*b* for driving the fuel injector 3 at low speed.

The high voltage supply 6*a* is connected to a booster circuit which boosts a battery voltage. The voltage "VF1" of the high voltage supply 6*a* is 40V. The low voltage supply 6*b* is connected to a battery of a vehicle. The Voltage VF2 of the low voltage supply 6*b* is lower than the voltage VF1 of the high voltage supply 6*a*. The voltage "VF2" of the low voltage supply 6*b* is 12V.

The ECU 5 has a processing unit (CPU) 7 and a memory (MMR) 8 in which programs are stored. The ECU 5 is a microcomputer having a memory media. The memory media stores various programs which the computer executes. The memory media is a semiconductor memory or a magnetic disc.

The CPU7 executes the programs stored in the memory 8 to perform a control of the fuel injector 3. The CPU 7 has a plurality of control portions.

The CPU 7 has a small-injection portion 7*a* for obtaining a small fuel injection quantity. The small injection quantity is obtained by stopping a supply of the valve-opening voltage before the fuel injector 3 reaches the full-open position from the full-close position.

The small-injection portion 7*a* has a first valve-open control portion 7*b*. The first valve-open control portion 7*b* supplies the valve-opening voltage to the coil 3*c* for opening the fuel injector 3. Furthermore, the first valve-open control portion 7*b* stops a supply of a valve-opening voltage after a predetermined period has elapsed. The first valve-open control portion 7*b* may stop supplying the electric supply to the coil 3*c* before the fuel injector 3 is positioned at a full-open position. The first valve-open control portion 7*b* controls the drive circuit 6 in such a manner that the high voltage supply 6*a* intermittently supply the electricity to the coil 3*c*. The valve-opening voltage is supplied to the coil 3*c* and magnetizing current flows. The first valve-open control portion 7*b* moves the needle 3*b* in a valve-opening direction and in a valve-closing direction.

The small-injection portion 7*a* includes a demagnetization portion 7*c*. The demagnetization portion 7*c* performs a demagnetization control. The demagnetization portion 7*c* performs the demagnetization control in order to quickly attenuate the residual magnetization energy remaining in the coil 3*c*.

In the demagnetization control, a demagnetization circuit is provided for attenuating the residual magnetism energy quickly. The demagnetization circuit can include a power source which supplies a reverse voltage contrary to a valve-opening voltage to the terminals 5*a*, 5*b*. The demagnetization circuit can be established by a closed circuit including the coil 3*c*. The demagnetization circuit is a closed circuit through which electricity generated by the counter-electromotive force supplied to the terminals 5*a*, 5*b* from the coil 3*c* flows. The demagnetization portion 7*c* controls the drive circuit 6 to form the closed circuit including the coil 3*c*. In a closed circuit, a circuit element for promoting attenuation of residual magnetism energy can be included. For example, a switching device, a resistor, etc.

In the demagnetization control, a reverse voltage relative to the valve-opening voltage can be supplied to the coil 3*c*. The reverse voltage promotes attenuation of residual magnetism energy. In this case, the demagnetization portion 7*c* controls the drive circuit 6 to supply the reverse voltage to the coil 3*c*.

The demagnetization portion 7*c* continues the demagnetization control from when the demagnetization control is started until when the fuel injector 3 is fully closed. The demagnetization control is terminated after the fuel injector 3 is fully closed. The demagnetization control may be terminated immediately before the fuel injector 3 is fully closed.

The small-injection portion 7*a* has a first valve-close control portion 7*d*. The first valve-close control portion 7*d* forms a closed circuit after the demagnetization portion 7*c* generates the demagnetization circuit. The closed circuit makes the terminals 5*a* and 5*b* into an open condition (OPEN). Alternatively, the closed circuit makes the terminals 5*a* and 5*b* into a short circuit condition to the earth potential (GND).

The CPU 7 has a normal-injection portion 7*e* for injecting a fuel of a normal injection quantity. The normal injection quantity is obtained by stopping a supply of the valve-opening voltage after the fuel injector 3 reaches the full-open position from the full-close position.

The normal-injection portion 7*e* includes a second valve-open control portion 7*f*. The second valve-open control portion 7*f* supplies the valve-opening voltage to the coil 3*c* for opening the fuel injector 3. Furthermore, the second valve-open control portion 7*f* stops a supply of a valve-opening voltage after a predetermined period has elapsed. The second valve-open control portion 7*f* stops supplying the electric supply to the coil 3*c* after the fuel injector 3 is positioned at a full-open position. The second valve-open control portion 7*f* controls the drive circuit 6 in such a manner that the high voltage supply 6*a* or the low voltage supply 6*b* intermittently supplies the electricity to the coil 3*c*. The valve-opening voltage is supplied to the coil 3*c* and magnetizing current flows. The second valve-open control portion 7*f* can move the needle 3*b* in a valve-opening direction or in a valve-opening direction.

Furthermore, the second valve-open control portion 7*f* has a valve-maintaining portion 7*g*. The valve-maintaining portion 7*g* keeps the electric current supplied to the terminals 5*a*, 5*b* at a target current, whereby the fuel injector 3 is kept full-open. The valve-maintaining portion 7*g* controls the drive circuit 6 in such a manner that the low voltage supply 6*a* supplies the electricity to the coil 3*c*. The valve-maintaining portion 7*g* controls the drive circuit 6 so that the electric current flowing through the coil 3*c* becomes a target current. Thereby, the power consumption in the valve-opening period is restricted. Moreover, since the power consumption is restricted, the fuel injector 3 promptly moves from the full-open position to the full-close position.

The normal-injection portion 7*e* includes a second valve-close control portion 7*h*. The second valve-close control portion 7*h* forms the stop circuit between the terminal 5*a*, 5*b* for maintaining the fuel injector 3 at full-close position. The normal-injection portion 7*e* does not include the control function equivalent to the demagnetization portion 7*c*. Therefore, the demagnetization control is not performed in a normal fuel injection. After the valve-maintaining portion 7 controls the electricity, the demagnetization portion 7*c* does not form the demagnetization circuit. The second valve-close control portion 7*h* closes the fuel injector 3 without generating the demagnetization circuit by the demagnetization portion 7*c*.

Figure 2:
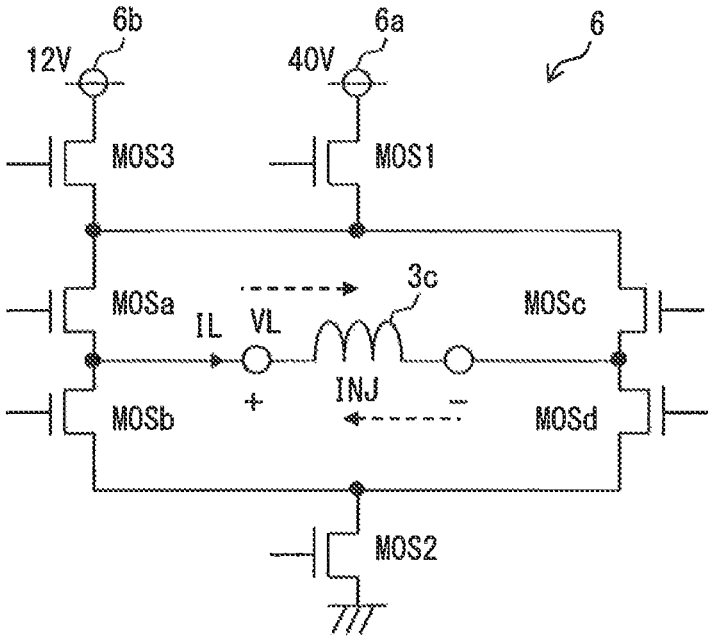
FIG. 2 is a circuit diagram of a driving circuit according to the first embodiment.

As shown in FIG. 2, the drive circuit 6 has H-bridge circuit including the coil 3*c*. The H-bridge circuit has MOSa, MOSb, MOSc and MOSd. The H-bridge circuit selectively turns ON the MOSa, MOSd or MOSb, MOSc, whereby the applied voltage to the coil 3*c* can be reversible in its direction.

A MOS1 is provided between the high voltage supply 6*a* and the H-bridge circuit. A MOS2 is provided between the H-bridge circuit and the earth potential A MOS3 is provided between the low voltage supply 6*b* and the H-bridge circuit. Therefore, the electric power can be supplied to the coil 3*c* of H-bridge circuit from the high voltage supply 6*a* or the low voltage supply 6*b*.

Above MOSa, MOSb, MOSc, MOSd, MOS1, MOS2 and MOS3 are switching devices. These switching devices are power MOSFET (metal oxide semiconductor field effect transistor). The switching device may be a bipolar transistor, or an IGBT (insulated gate type bipolar transistor).

The drive circuit 6 can selectively supply the valve-opening voltage (VF1, VF2), the stopping voltage (GND, OPEN) or the reverse voltage (VR) to the terminals 5*a*, 5*b*. The reverse voltage VR is a reverse of the voltage VF1 supplied from the high voltage supply 6*a* to the terminals 5*a*, 5*b*. (VR=−VF1) The drive circuit 6 can selectively supply the valve-opening voltage (VF1, VF2) or the stopping voltage (GND, VR) to the terminals 5*a*, 5*b*.

Figure 3:
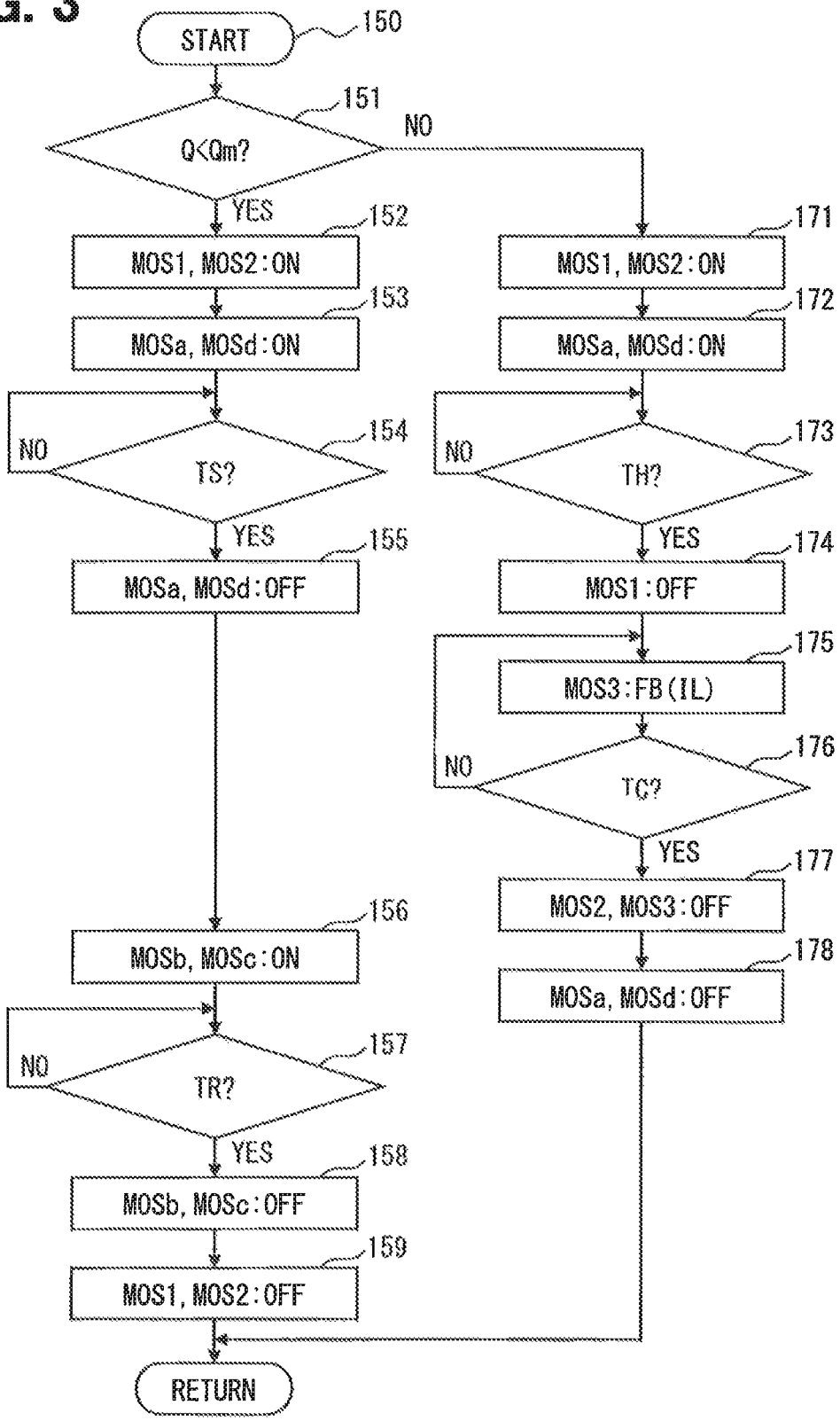
FIG. 3 is a flowchart illustrating a control processing according to the first embodiment.

FIG. 3 is a flowchart showing a processing for controlling the drive circuit 6. This processing is started when a fuel injection command is generated. In step 151, the ECU 5 determines whether a fuel injection quantity "Q" is less than a threshold "Qm". Based on the threshold "Qm", the ECU 5 determines whether the current injection quantity is the small injection quantity or the usual injection quantity. When the answer is YES in step 151, the procedure proceeds to step 152. The processes in steps 152-159 correspond to the small-injection portion 7*a*. When the answer is NO in step 151, the procedure proceeds to step 171. The processes in steps 171-178 correspond to the normal-injection portion 7*e*.

In step 152, the ECU 5 turns ON the MOS1 and the MOS2. In step 153, the ECU 5 turns ON the MOSa and the MOSd. Thereby, the valve-opening voltage "VF1" is supplied to the coil 3*c* from the high voltage supply 6*a*. The electric current flows through the coil 3*c*, and the coil 3*c* is magnetized. The needle 3*b* is attracted towards the stator 3*a*. The fuel injector 3 starts a valve opening action. The needle 3*b* is gradually lifted up.

In step 154, the ECU 5 determines whether an electric supply period "TS" has elapsed. The electric supply period "TS" is established based on the fuel injection quantity "Q". During the electric supply period "TS", an electric power is supplied from the high voltage supply 6*a* to the coil 3*c* in order to obtain the small fuel injection quantity "Q". Until the electric supply period "TS" has elapsed, the ECU 5 continues the electric supply to the coil 3*c*. When the electric supply period "TS" has elapsed, the procedure proceeds to step 155. As a result, the needle 3*b* is gradually lifted up until the electric supply period "TS" has elapsed. The fuel injector 3 is gradually opened and the fuel injection quantity is gradually increased.

In step 155, the ECU 5 turns OFF the MOSa and the MOSd. Thereby, the supply of valve-opening voltage is terminated. The magnetization of the coil 3*c* is also terminated. The needle 3*b* stops the movement in the valve-open direction and then starts to be apart from the stator 3*a*. That is, the fuel injector 3 starts a valve closing operation before being fully opened. The lift amount of the needle 3*b* decreases gradually.

In step 156, the ECU 5 turns ON the MOSb and the MOSc. A circuit which supplies the reverse voltage (VR) to the coil 3*c* from the high voltage supply 6*a* to a valve-opening voltage is formed. As a result, the demagnetization control is performed. In this case, the voltage supplied to the terminals 5*a*, 5*b* is the reverse voltage (VR). This reverse voltage level is also the voltage for closing the fuel injector 3. This reverse voltage corresponds to the stopping voltage. This valve-closing voltage is also the voltage which demagnetizes the magnetism remaining in the coil 3*c*. The demagnetization portion 7 controls the drive circuit 6 to supply the valve-closing voltage (VR) instead of the valve-opening voltage (VF1). The demagnetization portion 7*c* controls the drive circuit 6 to supply the reverse voltage (VR) to the coil 3*c* instead of the valve-opening voltage (VF1).

The residual magnetism energy is disappeared by the reverse voltage. The magnetic force which the coil 3*c* generates decreases quickly. As a result, the needle 3*b* moves away from the stator 3*a*. The lift amount of the needle 3*b* decreases rapidly. The fuel injector 3 is quickly closed.

In step 157, the ECU 5 determines whether a valve-closing period "TR" has elapsed. The valve-closing period "TR" is a time period which is necessary for the fuel injector 3 to be closed. The valve-closing period "TR" corresponds to a time delay from when the coil 3*c* is deenergized until when the fuel injector 3 is closed. The valve-closing period "TR" can be a predetermined fixed value or a variable value according to the fuel injection quantity "Q".

When the valve-closing period "TR" has elapsed, the procedure proceeds to step 158. As a result, until the valve-closing period "TR" has elapsed, the reverse voltage is supplied to the coil 3*c*. The lift amount of the needle 3*b* decreases quickly. The fuel injector 3 is rapidly closed and the fuel injection quantity is rapidly decreased.

In step 158, the ECU 5 turns OFF the MOSb and the MOSc. In step 159, the ECU 5 turns OFF the MOS1 and the MOS2. Thereby, the supply of reverse voltage is terminated. A stop circuit is formed between the terminals 5*a*, 5*b*. In this case, the voltage supplied to the terminals 5*a*, 5*b* is an open voltage level (OPEN). This voltage level is also the voltage for closing the fuel injector 3. No electric current flows through the coil 3*c* thoroughly.

The processes in steps 157-159 corresponds to the first valve-close control portion 7*d*. The first valve-close control portion 7*d* forms a stop circuit for maintaining the fuel injector 3 at the full-close position. The first valve-close control portion 7*d* supplies the valve-closing voltage (OPEN) after the fuel injector 3 is fully closed.

In step 171, the ECU 5 turns ON the MOS1 and the MOS2. In step 172, the ECU 5 turns ON the MOSa and the MOSd. Thereby, the valve-opening voltage "VF1" is supplied to the coil 3*c* from the high voltage supply 6*a*. The electric current flows through the coil 3*c*, and the coil 3*c* is magnetized. The needle 3*b* is attracted towards the stator 3*a*. The fuel injector 3 starts a valve opening action. The needle 3*b* is gradually lifted up.

In step 173, the ECU 5 determines whether a high-voltage period "TH" has elapsed. The high-voltage period "TH" is an energization period in which high voltage is supplied to the coil 3*c* from the high voltage supply 6*a* in order to open the fuel injector 3 at high speed. The high-voltage period "TH" is a time period which is necessary for the fuel injector 3 to move from the full-close position to the full-open position.

When the high-voltage period "TH" has elapsed, the procedure proceeds to step 174. As a result, the needle 3*b* is gradually lifted up until the high-voltage period "TH" has elapsed. The fuel injector 3 is gradually opened and the fuel injection quantity is gradually increased.

In step 174, the ECU 5 turns OFF the MOS1. Thereby, the supply of valve-opening voltage from the high voltage supply 6*a* is terminated. The magnetization of the coil 3*c* is also terminated. The MOS2 is maintained ON.

In step 175, the ECU 5 starts a switching control of the MOS3. The ECU 5 controls the MOS3 so that the electric current "IL" flowing through the coil 3*c* becomes a target current. Thereby, the valve-opening voltage "VF2" is supplied to the coil 3*c* from the low voltage supply 6*b*. The target current is established in such a manner as to maintain the fuel injector 3 at the full-open position. The target current is smaller than the maximum current which the low voltage supply 6*b* can supply to the coil 3*c*. The target current is established in such a manner as to maintain the fuel injector 3 at the full-open position. As a result, the coil 3*c* is magnetized state at the minimum level.

In step 176, the ECU 5 determines whether a valve-holding period "TC" has elapsed. The valve-holding period "TC" is a time period in which the fuel injector 3 is kept open. The valve-holding period "TC" can be established according to the fuel injection quantity "Q". When the valve-holding period "TC" has elapsed, the procedure proceeds to step 177. As a result, until the valve-holding period "TC" has elapsed, the valve-opening voltage is supplied to the coil 3*c*.

In step 177, the ECU 5 turns OFF the MOS2 and the MOS3. Thereby, the supply of valve-opening voltage is terminated. The magnetization of the coil 3*c* is also terminated. The needle 3*b* moves away from the stator 3*a*. The fuel injector 3 starts a valve closing action. The lift amount of the needle 3*b* decreases gradually.

In step 178, the ECU 5 turns OFF the MOSa and the MOSd. Both end terminals of the coil 3*c* are opened (OPEN).

In the normal injection (steps 171-178), no demagnetization control is performed. The residual magnetism energy is a little. The residual magnetism energy is lost at an early stage. As a result, the needle 3*b* moves away from the stator 3*a*. The lift amount of the needle 3*b* decreases rapidly. The fuel injector 3 is quickly closed.

Figure 4:
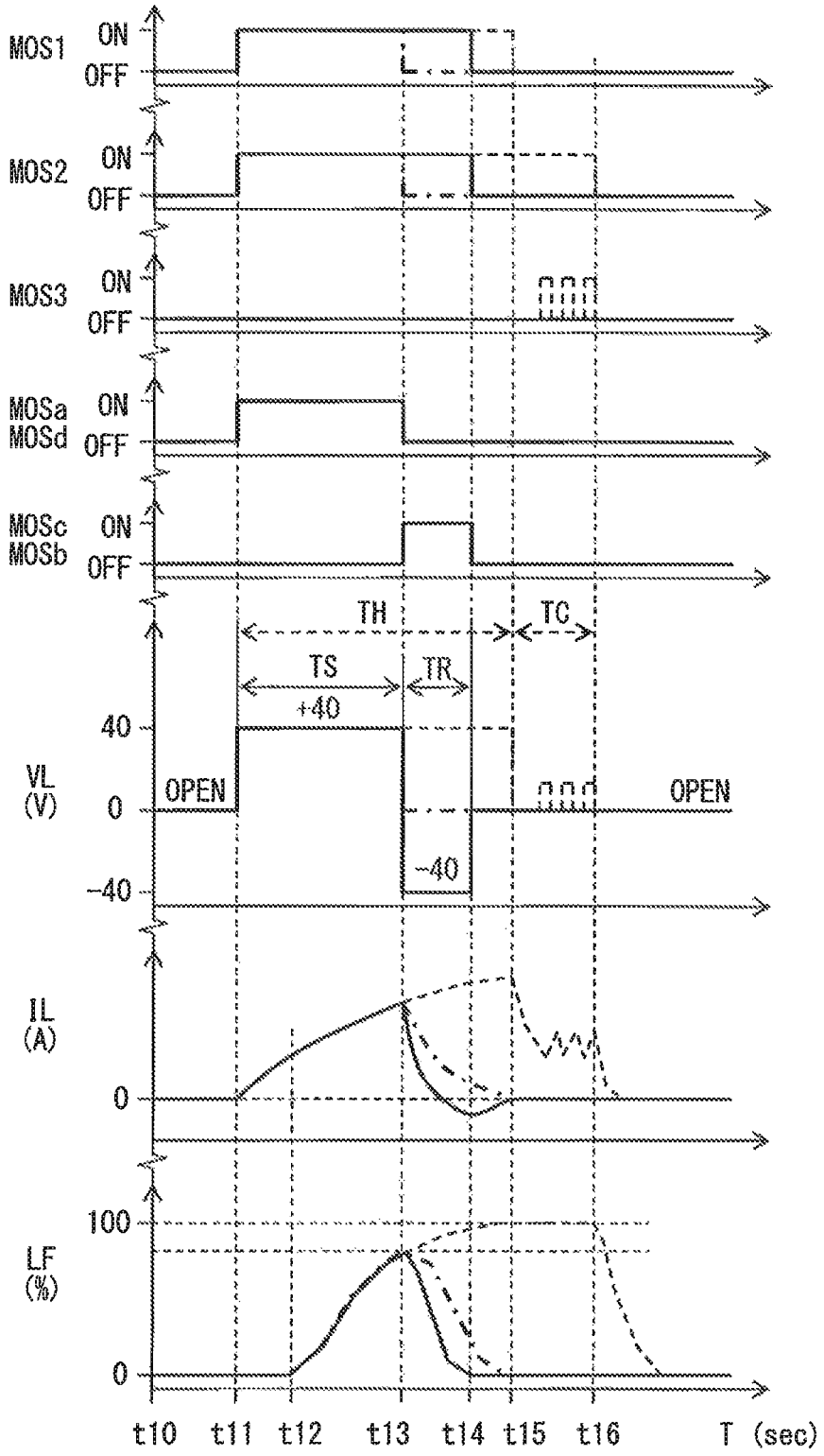
FIG. 4 is a time chart showing an operation according to the first embodiment.

FIG. 4 is a time chart showing an operation of the present embodiment. "VL" denotes the voltage at a plus terminal of the coil 3*c*, "IL" denotes the electric current flowing through the coil 3*c*, and "LF" denotes the lift amount of the needle 3*b*.

In FIG. 4, solid lines show operations of the small injection quantity. At the time "t11", the voltage is supplied to the coil 3*c*. In electric supply period "TS" from "t11" to "t13", the voltage "VL" is "VF1". The electric current "IL" is gradually increased. At the time "t12", the lift amount "LF" of the needle 3*b* starts increasing.

In a case of small injection quantity, the electric supply period "TS" elapses before the fuel injector 3 is positioned at the full-open position. In FIG. 4, the electric supply period "TS" expires at the time "t13". At the time "t13", the direction of the electric current is reversed by the H-bridge circuit. The voltage "VL" is also reversed to the voltage "VR". Thereby, the voltage for demagnetization is supplied to the coil 3*c*. The electric current IL decreases quickly and becomes lower than zero before the time "T14". The residual magnetism energy of the coil 3*c* is decreased quickly. Therefore, the lift amount LF decreases quickly.

The lift amount "LF" returns to 0% at the time "t14". That is, at the time "t14", the fuel injector 3 is fully closed. At the time "t14", all of the MOS1-MOS3 and MOSa-MOSd are turned OFF. After the fuel injector 3 is fully closed, the voltage applied to the coil 3*c* is changed to a full-close voltage. The full-close voltage corresponds to situation in which both ends of the coil 3*c* are opened (OPEN).

In FIG. 4, dashed lines show operations of the normal injection quantity. In the usual fuel injection, the voltage is supplied to the fuel injector 3 from the high voltage supply 6*a*. The lift amount LF reaches 100% at the time "t15". The high-voltage period TH is a period between the time "t11" and the time "t15". At the time "t15", the MOS1 is turned OFF. The switching control of the MOS3 is started at the time "t15". As a result, the voltage is intermittently supplied to the coil 3*c* from the low voltage supply 6*b*. The Electric current IL is controlled to become the target current. The lift amount "LF" Is maintained at a full open condition. When the valve-holding period "TC" has passed at "t16", the MOS2 is turned OFF. The switching control of the MOS3 is terminated. The electric current "IL" is gradually decreased and the lift amount "LF" is also decreased.

In FIG. 4, chain lines shows operations of a case where demagnetization control is not performed in the small injection quantity. In this case, at the time "t13", the MOS1 and the MOS2 are turned OFF. That is, before the fuel injector 3 is fully opened, the voltage supply to the coil 3*c* is terminated. The residual magnetism energy of the coil 3*c* is gradually decreased. The lift amount LF also decreases gradually. The fuel injector 3 is fully closed at the time "t15". During a period from the time "t13" to the time "t5", the fuel injection is continued. This period varies due to a mechanical dimension error of the fuel injector 3 and the environmental temperature. For this reason, when the demagnetization control is not performed, the small injection quantity includes some errors.

As described above, the supply of the valve-opening voltage is terminated before the fuel injector 3 is fully opened. Thereby, the fuel injection of small quantity can be obtained.

Further, when the supply of the valve-opening voltage is terminated, a circuit for attenuating the magnetic force of the coil 3*c* is formed. For this reason, the magnetic force of the coil 3*c* attenuates quickly. The fuel injector 3 moves in a valve closing direction quickly to be fully closed. As a result, the error of fuel injection quantity is restricted. The small fuel injection quantity can be controlled with high accuracy.

And according to the present embodiment, before the fuel injector 3 is fully closed and after the supply of a valve-opening voltage is terminated, the reverse voltage is supplied to the coil 3*c*. For this reason, the electric current flowing through the coil 3*c* is decreased quickly, and the magnetic force of the coil 3*c* quickly decreases. As a result, the error of fuel injection quantity is restricted.

Furthermore, according to this embodiment, after the fuel injector 3 is fully closed, the reverse voltage is stopped and the voltage supplied to the coil 3*c* is set to zero volt. The demagnetization of the coil 3*c* is promoted.

Second Embodiment

In the above embodiment, the reverse voltage for demagnetization is supplied to the coil 3*c*. However, only the closed circuit for demagnetization may be formed without supplying the reverse voltage. For example, a closed circuit CC1 having a resistor "R" for attenuating the electric current resulting from the residual magnetism energy of the coil 3*c* can be formed.

Figure 5:
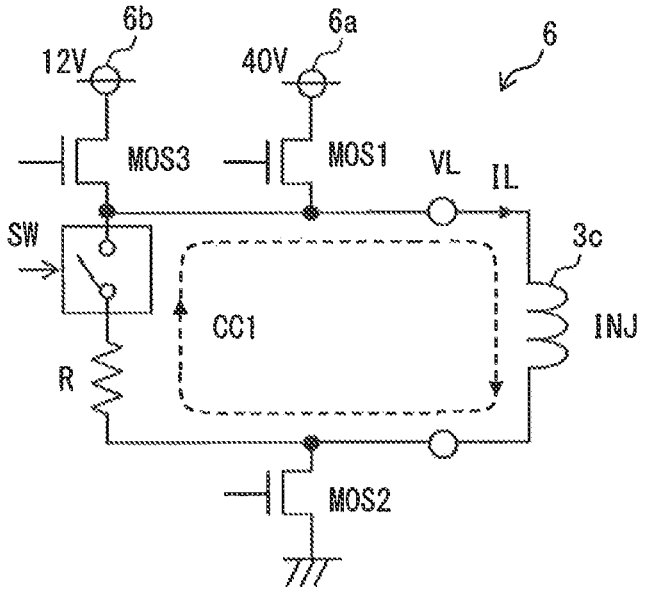
FIG. 5 is a circuit diagram of a driving circuit according to a second embodiment.

In FIG. 5, the drive circuit 6 of the second embodiment does not have H-bridge circuit. The drive circuit 6 is provided with a switching device "SW" and a resistor "R" between the terminals 5*a*, 5*b*. The switching device "SW" is a semiconductor switching device, such as a MOSFET. Alternatively, the switching device "SW" may be a diode. The diode "Df" closes the closed circuit CC1 including the coil 3*c* and the resistor "R" by counter-electromotive force induced by the coil 3*c*. The diode "Df" stops supplying electric power through the resistor "R", when the high voltage supply 6*a* or the low voltage supply 6*b* supplies electric power to the coil 3*c*.

Figure 6:
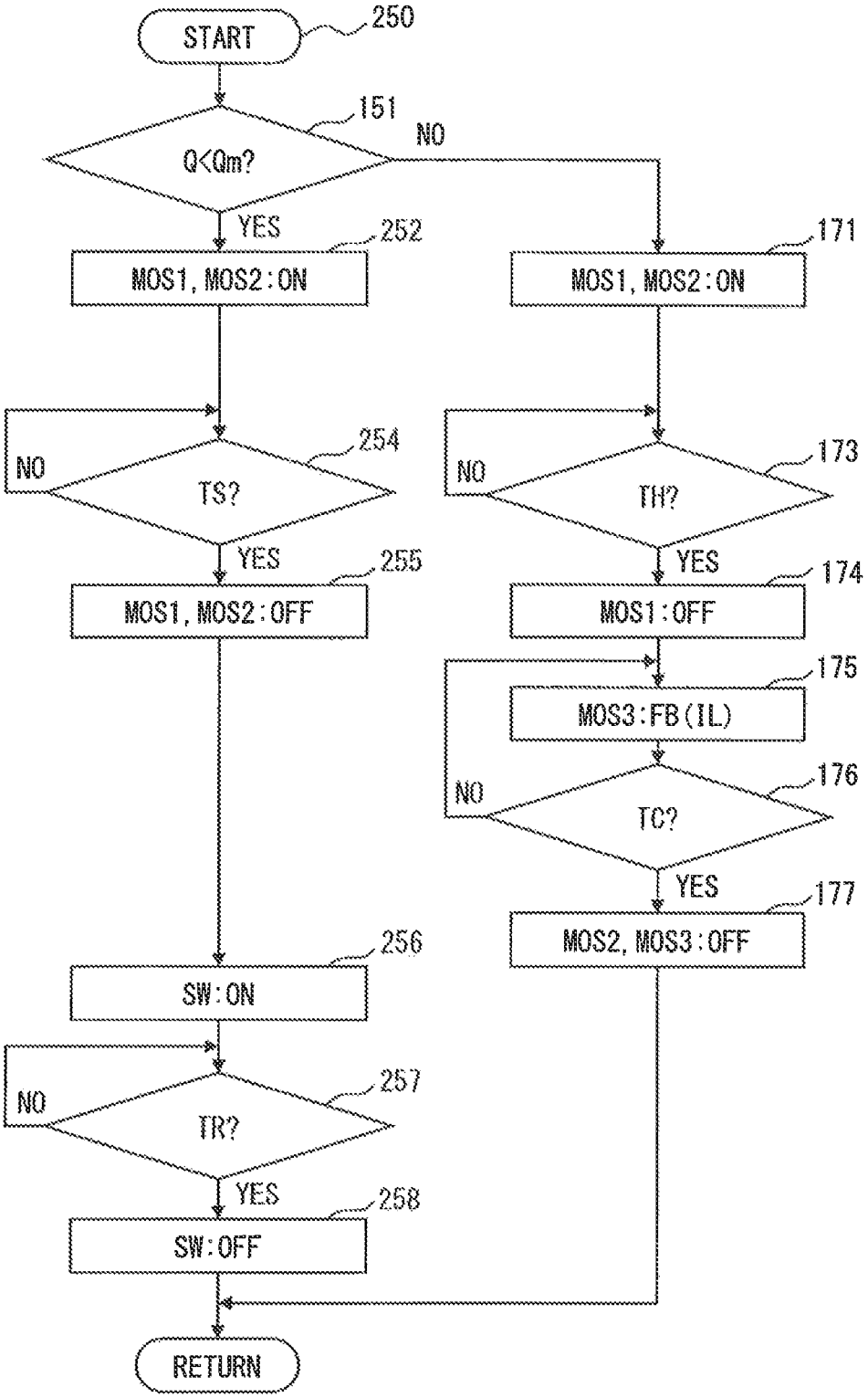
FIG. 6 is a flowchart illustrating a control processing according to the second embodiment.

FIG. 6 is a flowchart showing a processing for controlling the drive circuit 6. The same processes as those in the above embodiments are indicated with the same reference numerals.

In step 252, the ECU 5 turns ON the MOS1 and the MOS2. Thereby, the valve-opening voltage "VF1" is supplied to the coil 3*c* from the high voltage supply 6*a*.

In step 254, the ECU 5 determines whether the electric supply period "TS" has elapsed. When the electric supply period "TS" passes, the ECU 5 turns OFF the MOS1 and the MOS2 in step 255. Thereby, the supply of valve-opening voltage is terminated.

In step 256, the ECU 5 turns ON the switching device "SW". As a result, the closed circuit "CC1" including the coil 3*c* and the resistor R is formed. As a result, the demagnetization control is performed.

In this case, the voltage supplied to the terminals 5*a*, 5*b* is a short circuit voltage level (GND). This voltage level is also the voltage for closing the fuel injector 3. This voltage level is the valve-closing voltage. This valve-closing voltage is also the voltage which demagnetizes the magnetism remaining in the coil 3*c*. The demagnetization portion 7*c* controls the drive circuit 6 to supply the valve-closing voltage (GND) instead of the valve-opening voltage (VF1).

The closed circuit CC1 has low impedance relative to the counter-electromotive force induced by the coil 3*c*. An electricity flows through the closed circuit CC1.

In step 257, the ECU 5 determines whether the valve-closing period "TR" has elapsed. When the valve-closing period "TR" has elapsed, the procedure proceeds to step 258. As a result, until the valve-closing period "TR" has elapsed, the closed circuit CC1 is closed. Since the closed circuit CC1 has the resistor "R", the residual magnetism energy of the coil 3*c* is attenuated quickly.

In step 258, the ECU 5 turns OFF the switching device "SW". No electric current flows through the coil 3*c* thoroughly. The processes in steps 257-258 corresponds to the first valve-close control portion 7*d*.

The processes in steps 252, 254 to 258 correspond to the small-injection portion 7*a*. The processes in steps 171, 173 to 177 correspond to the normal-injection portion 7*e*.

Figure 7:
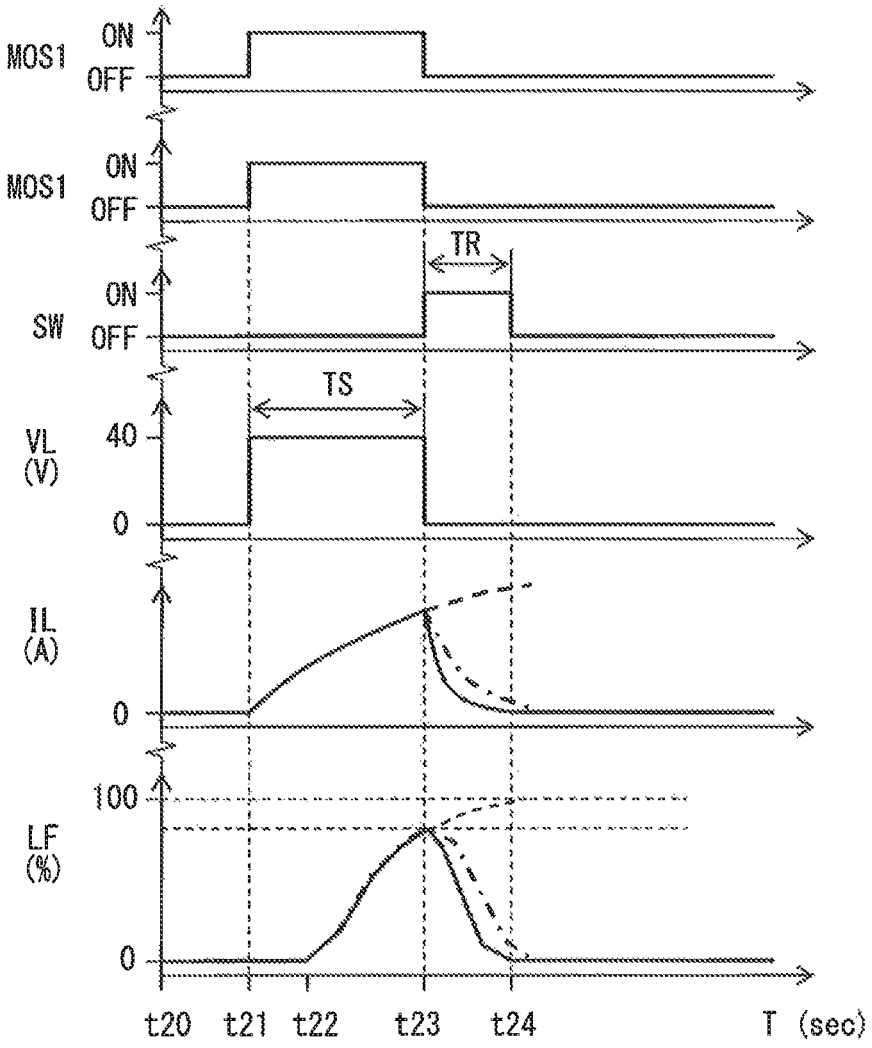
FIG. 7 is a time chart showing an operation according to the second embodiment.

FIG. 7 is a time chart showing an operation of the present embodiment. In FIG. 7, solid lines show operations of the small injection quantity. At the time "t21", the voltage is supplied to the coil 3*c*. In electric supply period "TS" from "t21" to "t23", the voltage "VL" is supplied. The voltage "VL" is +40V. The electric current "IL" is gradually increased. At the time "122", the lift amount "LF" of the needle 3*b* starts increasing.

In a case of small injection quantity, the electric supply period "TS" elapses before the fuel injector 3 is positioned at the full-open position. In FIG. 7, the electric supply period "TS" expires at the time "t23". At the time "t23", the switching device "SW" is turned OFF. As a result, the closed circuit "CC1" including the coil 3*c* is closed. The electric current "IL" decreases quickly. The residual magnetism energy of the coil 3*c* is decreased quickly. Therefore, the lift amount LF decreases quickly.

The lift amount "LF" returns to 0% at the time "t24". That is, at the time "t24", the fuel injector 3 is fully closed. At the time "t24", all of the MOS1 to MOS3 are turned OFF, and the switching device SW is turned OFF. After the fuel injector 3 is fully closed, the voltage applied to the coil 3*c* is changed to a normal level.

According to this embodiment, demagnetization control is performed only by closing closed circuit CC1.

Third Embodiment

According to the third embodiment, a closed circuit CC2 which short-circuits between the terminal 5*a* and 5*b* is formed.

Figure 8:
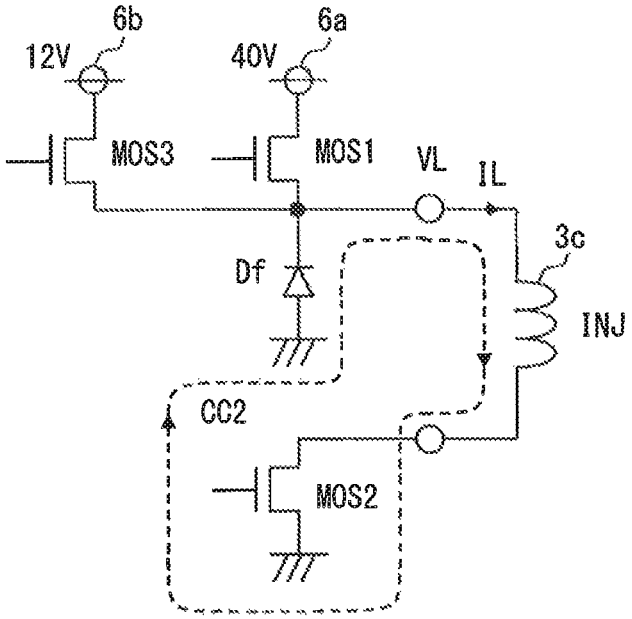
FIG. 8 is a circuit diagram of a driving circuit according to a third embodiment.

In FIG. 8, the drive circuit 6 of the third embodiment does not have H-bridge circuit. The drive circuit 6 is provided with a diode "Df" between the plus terminal of coil 3*c* and the earth potential. An anode of the diode "Df" is connected to the earth potential and a cathode is connected to the plus terminal of the coil 3*c*. The diode "Df" closes the closed circuit CC2 including the coil 3*c* by counter-electromotive force induced by the coil 3*c*. The diode "Df" stops supplying electric power through the closed circuit CC2, when the high voltage supply 6*a* or the low voltage supply 6*b* supplies electric power to the coil 3*c*.

Figure 9:
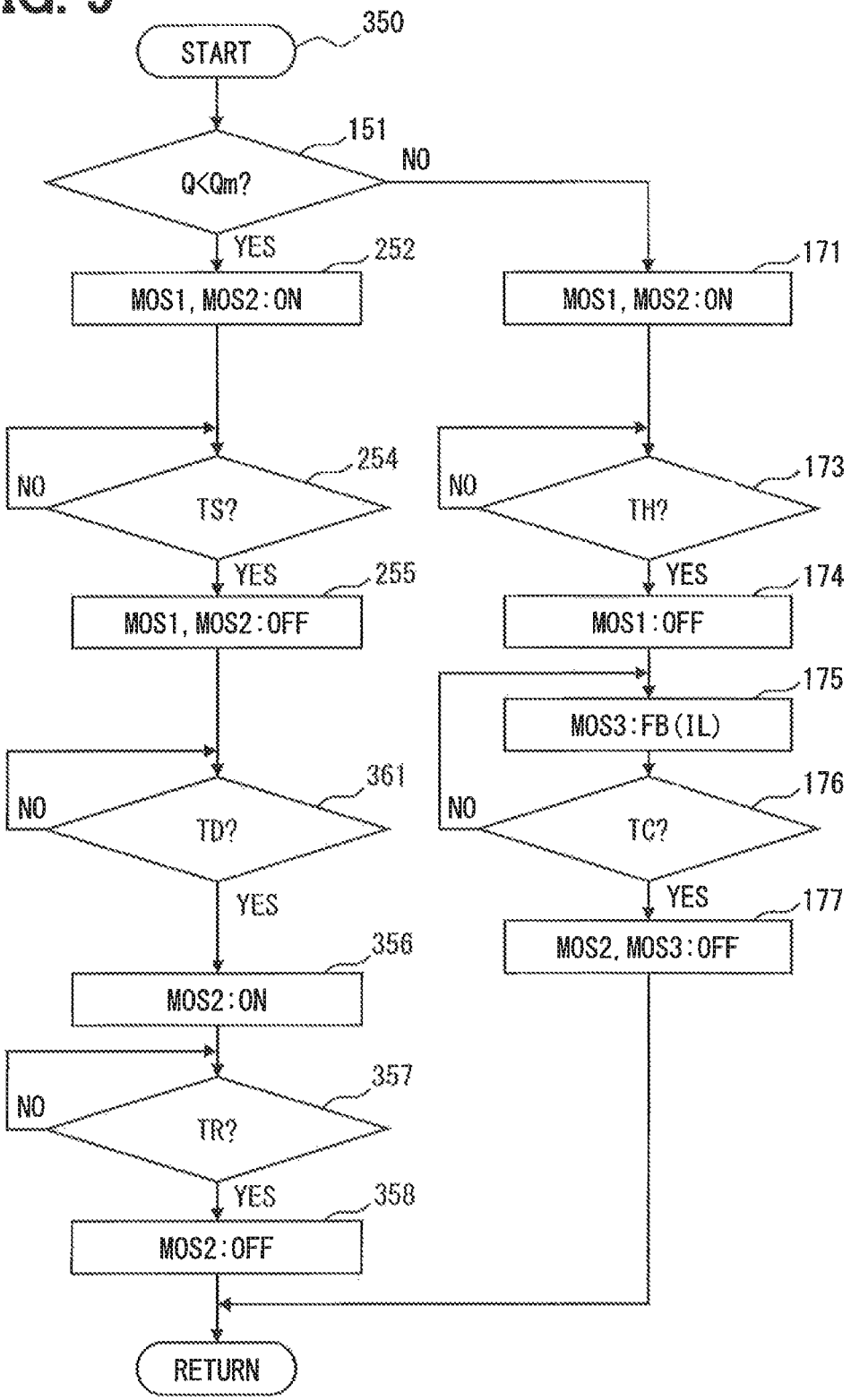
FIG. 9 is a flowchart illustrating a control processing according to the third embodiment.

FIG. 9 is a flowchart showing a processing for controlling the drive circuit 6. The same processes as those in the above embodiments are indicated with the same reference numerals.

In step 361, the ECU 5 determines whether a delay period "TD" has elapsed. When the delay period "TD" has elapsed, the procedure proceeds to step 356. As a result, until the delay period "TD" has passed, both ends of the coil 3*c* are set to the open condition.

When a supply of the valve-opening voltage to the coil 3*c* is stopped in step 255, the counter-electromotive force is generated in the coil 3*c* by its self induction. The delay period "TD" is established in such a manner as to include a peak of the flyback voltage which appears between both terminals of the coil 3*c* by the counter-electromotive force. The delay period "TD" is established in such a manner as to expire when the flyback voltage decreases by a predetermined quantity. By opening the both end terminals of the coil 3*c* over the delay period "TD", the attenuation of the residual magnetism energy of the coil 3*c* can be promoted.

In step 356, the ECU 5 turns ON the MOS2. As a result, the closed circuit CC2 including the coil 3*c* and the diode "Df" is formed. As a result, the demagnetization control is performed.

In this case, the voltage supplied to the terminals 5*a*, 5*b* is a short circuit voltage level (GND). This voltage level is also the voltage for closing the fuel injector 3. This voltage level is valve-closing voltage. This valve-closing voltage is also the voltage which demagnetizes the magnetism remaining in the coil 3*c*. The demagnetization portion 7*c* controls the drive circuit 6 to supply the valve-closing voltage (GND) instead of the valve-opening voltage (VF1).

The closed circuit CC2 has low impedance relative to the counter-electromotive force induced by the coil 3*c*. An electricity flows through the closed circuit CC2.

In step 357, the ECU 5 determines whether a valve-closing period "TR" has elapsed. When the valve-closing period "TR" has elapsed, the procedure proceeds to step 358. As a result, until the valve-closing period "TR" has elapsed, the closed circuit CC2 is closed.

In step 358, the ECU 5 turns OFF the MOS2. No electric current flows through the coil 3*c* thoroughly. The processes in steps 357-358 corresponds to the first valve-close control portion 7*d*.

The processes in steps 252, 254, 255, 361, 365 to 358 correspond to the small-injection portion 7*a*. The processes in steps 171, 173 to 177 correspond to the normal-injection portion 7*e*.

Figure 10:
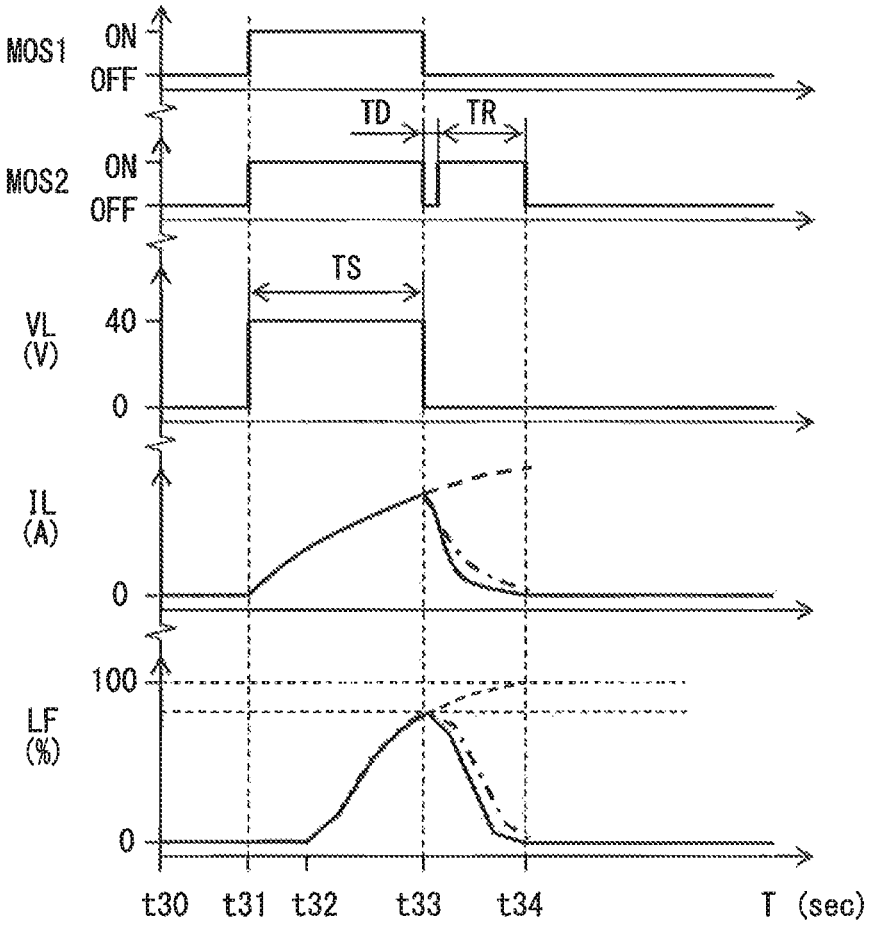
FIG. 10 is a time chart showing an operation according to the third embodiment.

FIG. 10 is a time chart showing an operation of the present embodiment. In FIG. 10, solid lines show operations of the small injection quantity. At the time "t31", the voltage is supplied to the coil 3*c*. In electric supply period "TS" from "t31" to "t33", the voltage "VL" is "VF1". The electric current "IL" is gradually increased. At the time "t32", the lift amount "LF" of the needle 3*b* starts increasing.

In a case of small injection quantity, the electric supply period "TS" elapses before the fuel injector 3 is positioned at the full-open position. The electric supply period "TS" expires at the time "t33". In this case, at the time "t33", the MOS1 and the MOS2 are turned OFF. Thereby, both terminal ends of the coil 3*c* are opened. When the delay period TD has passed, the MOS2 is turned ON. As a result, the closed circuit "CC2" Including the coil 3*c* is closed. The electric current "IL" decreases quickly. The residual magnetism energy of the coil 3*c* is decreased quickly. Therefore, the lift amount LF decreases quickly.

The lift amount "LF" returns to 0% at the time "t34". That is, at the time "t34", the fuel injector 3 is fully closed. At the time "t34", the MOS1 to the MOS3 are turned OFF. After the fuel injector 3 is fully closed, the voltage applied to the coil 3*c* is changed to a normal level.

According to this embodiment, demagnetization control is performed only by closing closed circuit CC2.

Other Embodiment

The preferred embodiments are described above. The present disclosure is not limited to the above embodiment.

For example, the control units can be configured by software, hardware or a combination thereof. For example, the ECU can be configured by an analog circuit.

When the fuel injector 3 is fully closed, the terminals 5*a*, 5*b* receive the full-close voltage. The full-close voltage corresponds to situation in which both ends of the coil 3*c* are opened (OPEN). Alternatively, both ends of the coil 3*c* may be switched to the short circuit condition (GND). The first valve-close control portion 7*d* controls the driving circuit 6 to supply the full-close voltage (GND) after the fuel injector 3 is fully closed.

The valve-opening voltage supplied from the high voltage supply 6*a* is +40V. The valve-opening voltage supplied from the low voltage supply 6*b* may be +12V.

In the third embodiment, step 361 may be deleted. In this case, the demagnetization portion 7*c* changes to the valve-opening voltage (VF1) to the valve-closing voltage (GND), without the delay period TD.

In the first embodiment and the second embodiment, the delay period TD may be set between the electric supply period TS and the valve-closing period TR.

Moreover, the voltage values of the high voltage supply 6*a* and the low voltage supply 6*b* can be changed.

What is claimed is:

1. A fuel injection controller, comprising:

terminals connectable to a coil that operates as an opening and closing coil of a fuel injector;

a valve-open control portion which supplies a valve-opening voltage to the terminals for opening the fuel injector and terminates the supply of the valve-opening voltage before the fuel injector is fully opened; and a demagnetization portion which forms a demagnetization circuit for demagnetizing a magnetism remaining in the opening and closing coil after supplying the valve-opening voltage, wherein:

the demagnetization circuit is a closed circuit through which an electricity flows through the terminals by a counter-electromotive force supplied to the terminals from the opening and closing coil;

the demagnetization portion:

sets the terminals to an open condition from when a supply of the valve-opening voltage is stopped until a delay period, including a peak of a flyback voltage that is generated by the counter-electromotive force, elapses, and then forms the closed circuit including the opening and closing coil after the delay period elapses such that:

the magnetism remaining in the opening and closing coil is decreased, and after another period elapses, an electricity flowing through the opening and closing coil is decreased;

the fuel injection controller further comprises a drive circuit that, as controlled by the valve-open control portion, supplies the valve-opening voltage or a valve-closing voltage to the terminals;

the drive circuit includes a first metal-oxide-semiconductor (MOS) transistor, a diode, and a second MOS transistor, the first MOS transistor being connected between a voltage supply and a positive terminal of the terminals, a cathode of the diode being connected to the positive terminal and an anode of the diode being connected to ground, and the second MOS transistor being connected between a negative terminal of the terminals and ground;

the valve-open control portion supplies the valve-opening voltage for opening the fuel injector by controlling the drive circuit to turn on both the first MOS transistor and the second MOS transistor;

the valve-open control portion terminates the supply of the valve-opening voltage before the fuel injector is fully opened by controlling the drive circuit to turn off both the first MOS transistor and the second MOS transistor;

the demagnetization portion:

controls the drive circuit to keep the second MOS transistor off during the delay period, and after the delay period, controls the drive circuit to form the closed circuit, which further includes the diode and the second MOS transistor, during the another period, including turning on the second MOS transistor during the another period, and further after the another period elapses, controls the drive circuit to turn off the second MOS transistor.

2. A fuel injection controller according to claim 1, wherein:

when the valve-open control portion terminates the supply of the valve-opening voltage before the fuel injector is fully opened, the valve-open control portion further controls the drive circuit so as to supply a valve-closing voltage instead of the valve-opening voltage.

3. A fuel injection controller according to claim 2, wherein the valve-closing voltage is a voltage which demagnetizes a magnetism remaining in the coil.

4. A fuel injection controller according to claim 1, further comprising:

a valve-close control portion forming a stop circuit for maintaining the fuel injector at the full-close position, after the demagnetization circuit is formed and the fuel injector is fully closed.

5. A fuel injection controller according to claim 1, wherein the counter-electromotive force supplied to the terminals from the opening and closing coil is generated by self-induction in the opening and closing coil.

6. A fuel injection controller according to claim 1, wherein:

the demagnetization portion maintains the closed circuit until the another period elapses.

7. A fuel injection controller according to claim 6, wherein after the another period elapses, the electricity flowing through the opening and closing coil is decreased until there is no electricity in the opening and controlling coil.

* * * * *